US009015975B2

(12) United States Patent
Blue et al.

(10) Patent No.: US 9,015,975 B2
(45) Date of Patent: Apr. 28, 2015

(54) MESSAGING SIGN HAVING A REVERSIBLE FASTENING SYSTEM FOR MOVEABLE DISPLAY ARTICLES

(71) Applicant: L&H Signs, Inc., Reading, PA (US)

(72) Inventors: Gregory Blue, Chester Springs, PA (US); Christopher Heinly, Wyomissing, PA (US); Lance Mansell, Reading, PA (US)

(73) Assignee: L&H Signs, Inc., Reading, PA (US)

( * ) Notice: Subject to any disclaimer, the term of this patent is extended or adjusted under 35 U.S.C. 154(b) by 0 days.

(21) Appl. No.: 13/745,126

(22) Filed: Jan. 18, 2013

(65) Prior Publication Data

US 2013/0192107 A1 Aug. 1, 2013

Related U.S. Application Data

(63) Continuation-in-part of application No. 13/360,009, filed on Jan. 27, 2012, now Pat. No. 8,484,872.

(51) Int. Cl.

| | |
|---|---|
| ***G09F 7/00*** | (2006.01) |
| ***G09F 7/10*** | (2006.01) |
| ***G09F 7/18*** | (2006.01) |

(52) U.S. Cl.

CPC ... *G09F 7/10* (2013.01); *G09F 7/18* (2013.01)

(58) Field of Classification Search

CPC ..... G09F 3/20; G09F 3/18; G09F 3/204; G09F 1/10; G09F 3/201; G09F 13/16; G09F 7/00; G09F 13/04; G09F 13/14; G02B 5/128

USPC ..... 40/649, 651, 652, 653, 654, 488, 490, 40/491; 434/405, 175, 199; 116/321–324; 206/308.3, 307.1, 308; D14/436

See application file for complete search history.

(56) References Cited

U.S. PATENT DOCUMENTS

| | | | | |
|---|---|---|---|---|
| 362,926 | A | 5/1887 | Benninghaus | |
| 2,951,301 | A | 9/1960 | Slavsky | |
| 3,314,548 | A | 4/1967 | Stewart | |
| 3,481,537 | A * | 12/1969 | Welch | 235/69 |
| 3,604,133 | A | 9/1971 | Hawa | |
| 3,824,722 | A | 7/1974 | Maruschak et al. | |
| 4,031,850 | A * | 6/1977 | Gantt | 116/323 |

(Continued)

OTHER PUBLICATIONS

Notification, International Search Report and Written Opinion of the International Searching Authority, International Application No. PCT/US2014/012057, dated Apr. 14, 2014, 11 pages.

(Continued)

*Primary Examiner* — Casandra Davis
(74) *Attorney, Agent, or Firm* — Barley Snyder

(57) ABSTRACT

The invention relates to a messaging sign apparatus with informative indicia moveable articles that externally display information regarding patient care. The messaging sign apparatus includes a frame, a movable article positionable within the frame, and fastening member that is engageable with the moveable article. The frame includes an article receiving section on an inner body thereof and an article receiving opening on an outer surface and leading into the article receiving section, with the moveable article positioned in the article receiving section and moveable through the article receiving opening. The fastening member is arranged on the frame and engageable with the moveable article to secure the moveable article within the frame into different displaying position.

60 Claims, 8 Drawing Sheets

(56) References Cited

U.S. PATENT DOCUMENTS

| | | | | |
|---|---|---|---|---|
| 4,625,675 | A * | 12/1986 | Rosenberg | 116/324 |
| 4,682,430 | A | 7/1987 | Ramsay | |
| 4,852,727 | A * | 8/1989 | Oberle | 206/39.4 |
| 5,253,441 | A | 10/1993 | Rachielle et al. | |
| 5,257,595 | A * | 11/1993 | Cassidy, Jr. | 116/321 |
| 5,608,979 | A | 3/1997 | Johnson | |
| 6,230,885 | B1 * | 5/2001 | Rochelo et al. | 206/308.3 |
| D455,751 | S * | 4/2002 | Hussaini et al. | D14/436 |
| 6,658,777 | B2 | 12/2003 | Dundorf | |
| 6,978,565 | B1 | 12/2005 | Tollius | |
| D516,076 | S * | 2/2006 | Ko | D14/436 |
| 7,263,669 | B2 | 8/2007 | Denholm | |
| 7,363,738 | B2 | 4/2008 | Burtch | |
| 7,757,847 | B2 * | 7/2010 | Tang et al. | 206/307.1 |
| 8,047,363 | B2 * | 11/2011 | Sheba et al. | 206/307 |
| 2001/0045037 | A1 | 11/2001 | Bank et al. | |
| 2003/0029064 | A1 | 2/2003 | Gordon et al. | |
| 2006/0225324 | A1 | 10/2006 | Culiver | |
| 2010/0051487 | A1 | 3/2010 | Sheba et al. | |
| 2012/0124871 | A1 | 5/2012 | Blue et al. | |
| 2012/0272553 | A1 | 11/2012 | Bell et al. | |

OTHER PUBLICATIONS

PCT Communication for Application No. PCT/US2014/012057, dated May 20, 2014, 1 page.

Notification of Transmittal of International Search Report and Written Opinion of the International Searching Authority, International Application No. PCT/US2014/012057, dated May 20, 2014, 1 pages.

International Search Report, International Application No. PCT/US2014/012057, 5 pages.

Written Opinion of the International Searching Authority, International Application No. PCT/US2014/012057, 5 pages.

* cited by examiner

MESSAGING SIGN HAVING A REVERSIBLE FASTENING SYSTEM FOR MOVEABLE DISPLAY ARTICLES

CROSS-REFERENCE TO RELATED APPLICATIONS

This application is a continuation-in-part application of U.S. application Ser. No. 13/360,009, filed Jan. 27, 2012.

FIELD OF THE INVENTION

The invention relates to a messaging sign and, in particular, it relates to a messaging having a reversible fastening system for moveable display articles.

BACKGROUND

Improving the overall quality of patient care has become a fundamental priority for healthcare providers. In order to provide utmost care, providers rely heavily on accurate communication between a patient and staff members, as well as directives between staff members. A breakdown of this communication may not only lead to irritable patients, but potentially fatal consequences.

Generally, various staff members attend to a patient's needs, including doctors, nurses and other hospital employees. The interchanging responsibility between each staff member requires clear verbal and visual communications to minimize confusion and miscommunication. Proper communication not only benefits the patient, but also the attending staff members and other neighboring patients, since it may be important to communicate any potential communicable illnesses that patient may have.

There has always been a problem in communicating patient care in a concise consistent manner. Although instructions and patient information may be shared on charts, computers and handwritten panels, the attending staff member may not have the time or understanding of the scribed remarks. In fact, the attending staff may have to rely on many different references, in various locations, in order to treat a patient. Communicating important information, in this manner, may not necessarily be efficient.

The healthcare industry, like many other industries, has adopted a simplistic system of universal indicia representing important directives. This system allows staff members to inform healthcare professionals of patient needs and concerns in a clear efficient manner.

Because it is normal for a nurse to transfer patient information to another incoming nurse during a shift change, nurse-messaging signs have become popular because they provide informative directives using predetermined symbols. Such systems provide an incoming nurse or attending doctor enough information needed to provide particular patient care without having to review numerous records. It may be important not to disrupt the patient's privacy, and so the messaging sign may provide the attending staff with advance warning. Fundamentally, these signs have become popular because they provide patient care instructions, such as medical warnings, in a consistent, effective manner.

U.S. Patent Application Publication No. 2001/0045037 discloses a patient care and medical alert system, which includes a message board for displaying information. The message board comprises a frame and cover, wherein the cover includes a permanent and temporary message area, and is free to rotate away from the frame. The permanent message area includes indicia relating to the permanent identifying information, including, but not limited to, a room number, wing and telephone extensions. The temporary message area is left available so that a user can use temporary message cards to detail temporary messages about a patient. The user can rotate the cover to an open position, in order to access a recessed portion of the frame. This recessed portion is configured and dimensioned in order to store a number of temporary message cards. The temporary message cards contain distinct indicia relevant to the care of the patient identified on the message board and can be affixed to the cover. The temporary message cards can be attached using a variety of fastening means, including, but not limited to, magnets, hook and loop, and adhesives. This type of signage system allows a nurse to provide a litany of information about the patient, but is dependent on message cards, which can be misplaced or removed very easily.

U.S. Patent Application Publication No. 2003/0029064 discloses a placard apparatus for display in a room for visually informing responding emergency personnel the occupant safety status. The placard apparatus comprises a front, middle and rear planar members, as well as slideable signage members. When assembled, the front, middle and rear planar members will house the slideable signage members in a formed article receiving opening area. The front planar member includes two apertures, one that is on the right edge and the other on the left edge. Additionally, the front planar member includes a central portion having indicia. The middle planar member acts as a spacer between the front and rear planar members, and has as large opening in the center. This acts as the article receiving opening area when the apparatus is assembled. The signage member, which includes indicia on the right and left sides, fits between the large opening. The user can move the signage member left or right to expose the appropriate indicia through the corresponding aperture. The signage member is designed to fit snug between the top and bottom edges of the middle planar member. However, the signage member is only wide enough to be viewed through one aperture when fully pushed up against the left or right side of the middle planar member. The middle planar member and signage member include features that comprise a latching system. This latching system locks the signage member into place when the user fully exposes information from the signage member through the right aperture, and a signage member notch becomes engaged with the latching system. A rear planar member, which has a narrow slotted opening, completes the placard system. This slotted opening provides the user access to the signage member in order to move and lock the signage member into place. This type of signage system is very limited in application, especially considering that the suggested latching system is not reversible.

U.S. Pat. No. 3,604,133 discloses an advertising card display comprising a plurality of cards enclosed within a hollow rectangular sleeve. The cards may contain text or symbols, in order to communicate information to a viewer. Each card has a pull tab means enabling the cards to be grasped and pulled from the left or right side of the sleeve. Projections on the leading end of the cards provide foot rest means for the cards, while the card is in retracted position. Projections on the trailing end serve as a means to prevent the cards from being withdrawn completely from the sleeve. Since the cards are stacked on each other in the sleeve, the rectangularly configured strips provide a stopping engagement with adjacent cards. The strips are secured on both sides of the leading end of the card. This acts a second stopping means. When one card is pulled out of the sleeve, the strip on other adjacent card acts to stop the pulled card from being completely removed from the sleeve. When the adjacent card is then pulled out in the opposite direction, the locking engagement automatically pulls the exposed card back into the sleeve. Several embodiments are further disclosed, but are all similar in operation. A problem exists with these designs in that the cards can be repositioned without a user unlocking the card first. The card being displayed can be accidentally removed from view, having serious repercussions.

SUMMARY

It is an object of the present invention to provide a messaging sign apparatus having informative indicia moveable articles that externally display information regarding patient care. The messaging sign apparatus includes a frame, a movable article positionable within the frame, and a fastening member that is engageable with the moveable article. The frame includes an article receiving section on an inner body thereof and an article receiving opening on an outer surface and leading into the article receiving section, with the moveable article positioned in the article receiving section and moveable through the article receiving opening. The fastening member is arranged on the frame and engageable with the moveable article to secure the moveable article within the frame into different displaying position.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Figure 1:
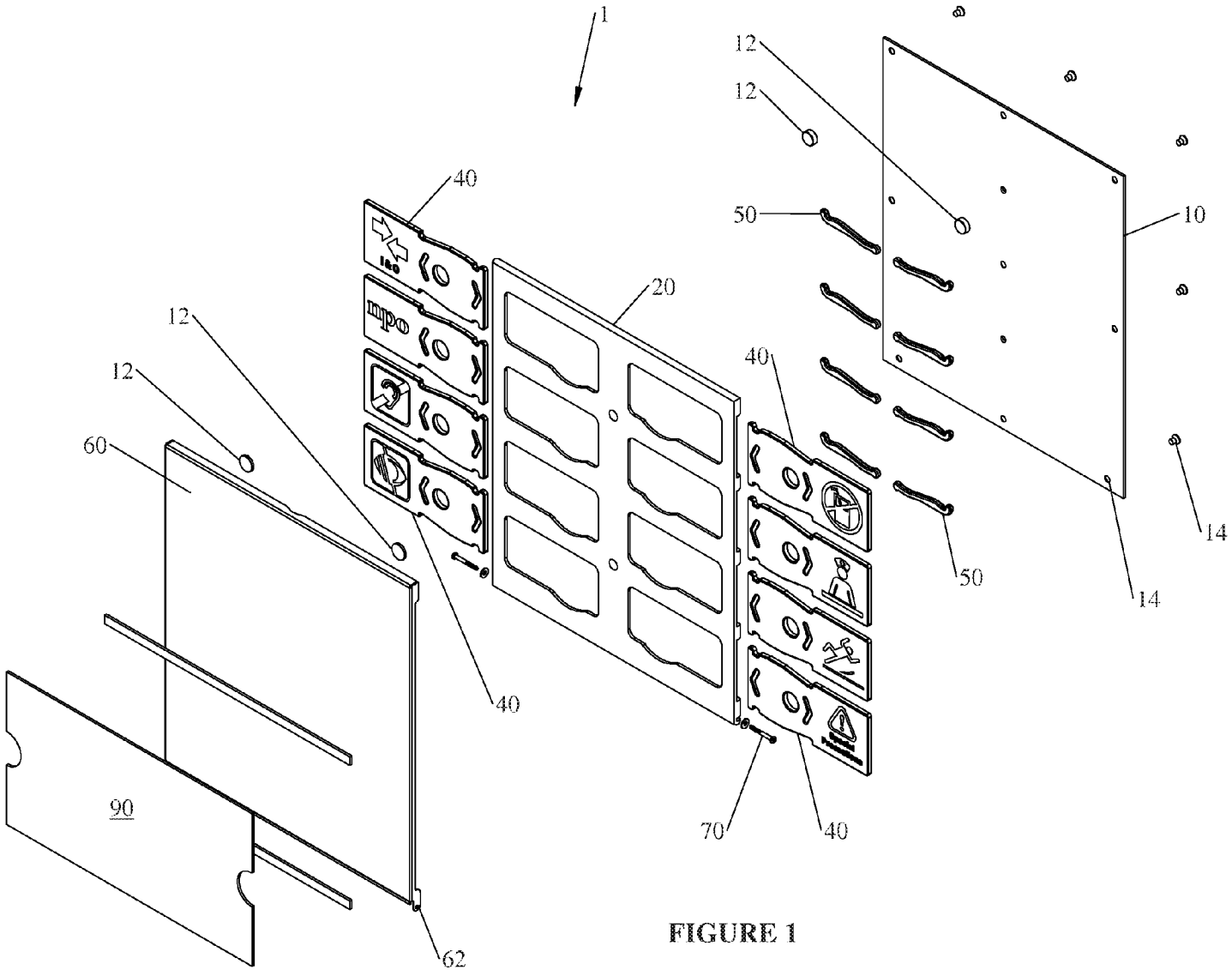
FIG. 1 is an exploded perspective view of a messaging sign according to the invention.

Now with reference to FIG. 1, the messaging sign 1 according to the invention is shown and includes the following major components: a base 10, a frame 20, a plurality of moveable articles 40, a plurality of fastening members 50, and a cover 60. As will be discussed, more or less of the aforementioned components can be used without departing from the spirit of the invention.

Now, each major component will be described in further detail, with reference to the drawings.

Figure 2:
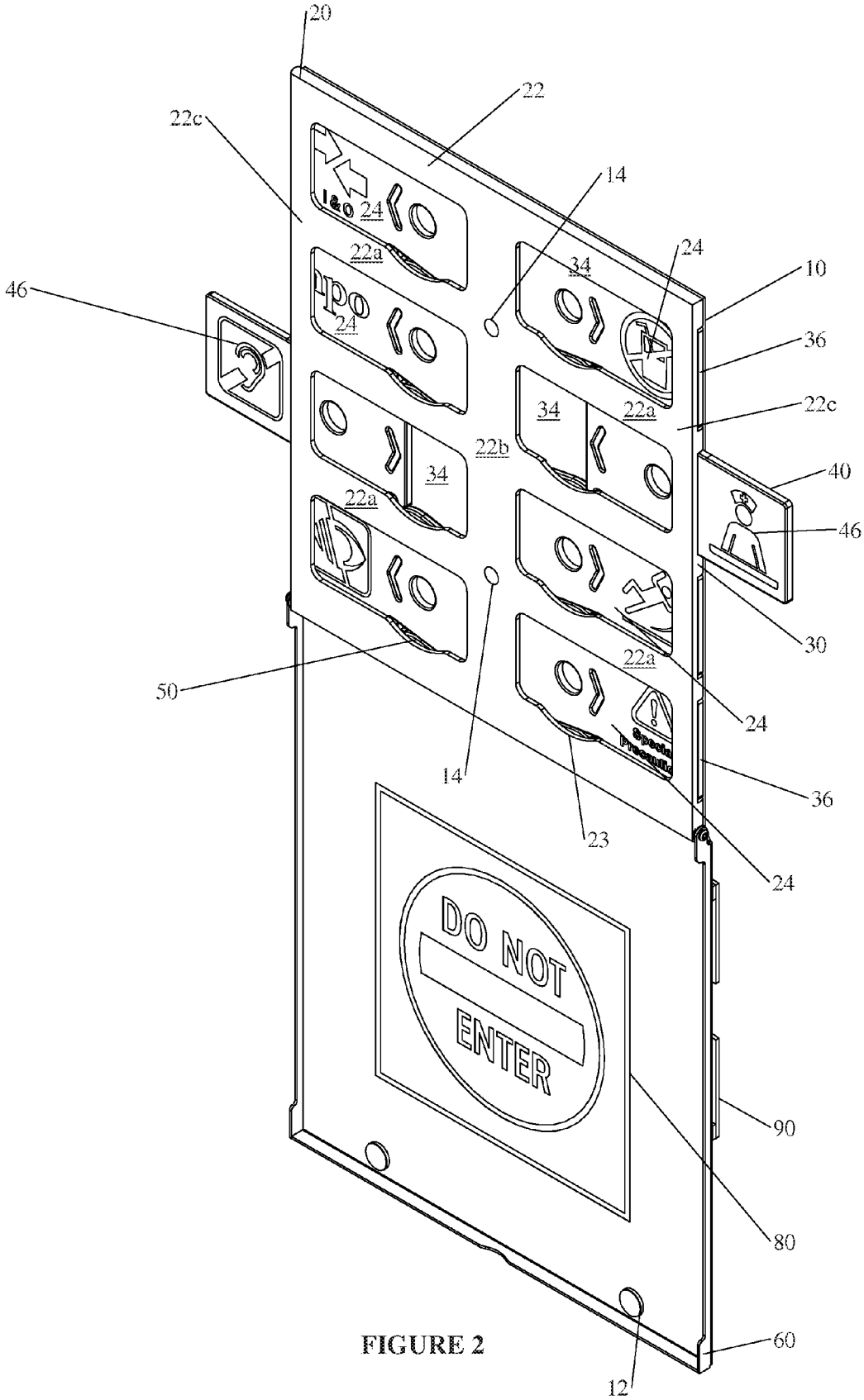
FIG. 2 is a perspective view of the messaging sign according to the invention, showing a cover rotated open and a frame holding a plurality of moveable articles.

As shown in FIGS. 1 and 2, the base 10 is a flat planar article having a mounting means disposed along a surface thereof. The mounting means could be a fastener element, such as screws, rivets, nails, hook and loop fastener, or other fasteners known to the art, or an adhesive, such as a tape, glue, a thermoset, a removable adhesive, or magnet. In the embodiment shown, the base 10 is a solid rectangular panel having a double-sided adhesive tape (not shown) disposed on the rear surface thereof. The base 10 is constructed from a manufactured material, such as plastic, but it could be understood by one skilled in the art that the manufactured material could be prepared from other materials, such as a metal, an organic material, or a composite.

Figure 3:
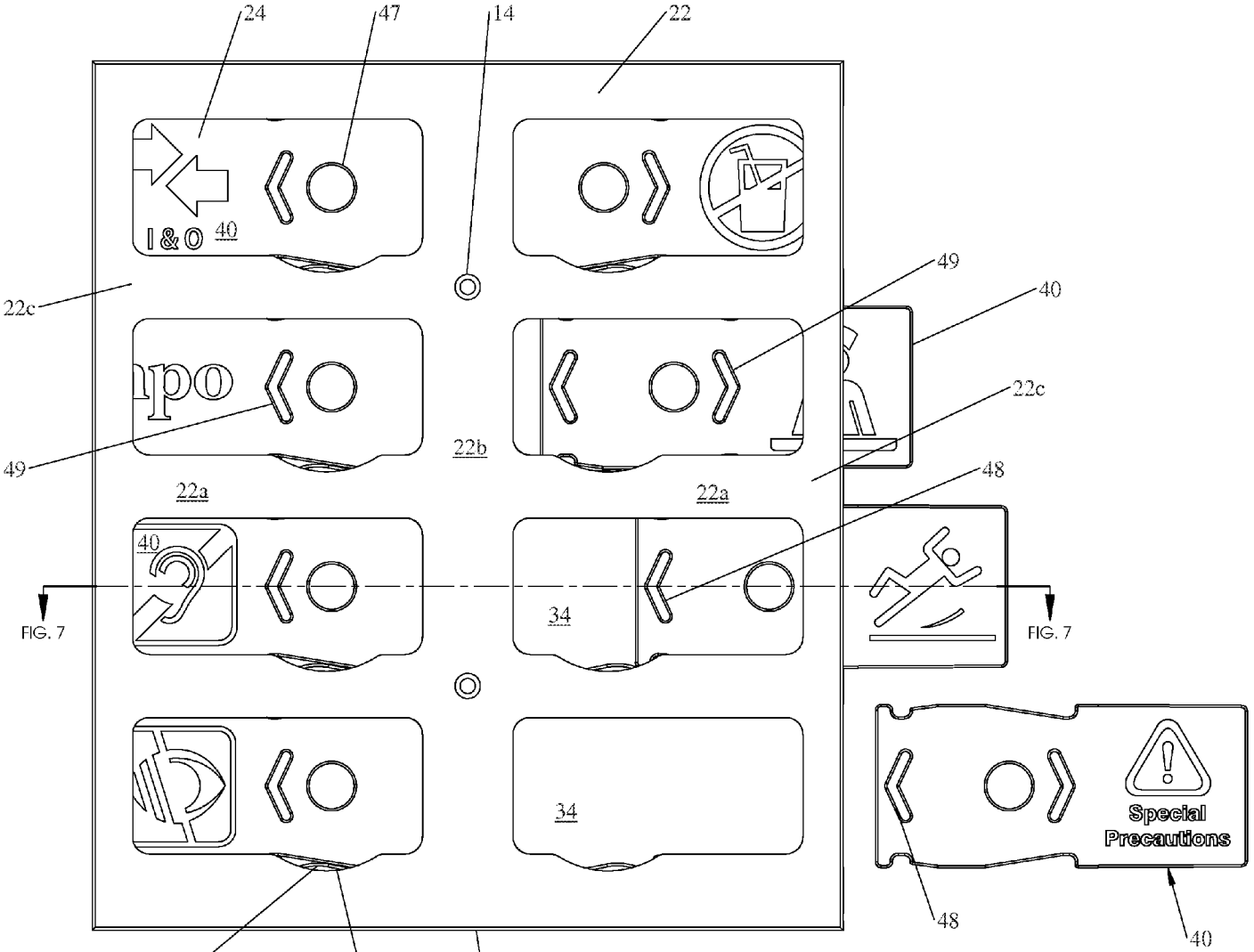
FIG. 3 is a frontal view of the frame of the messaging sign according to the invention.
Figure 4:
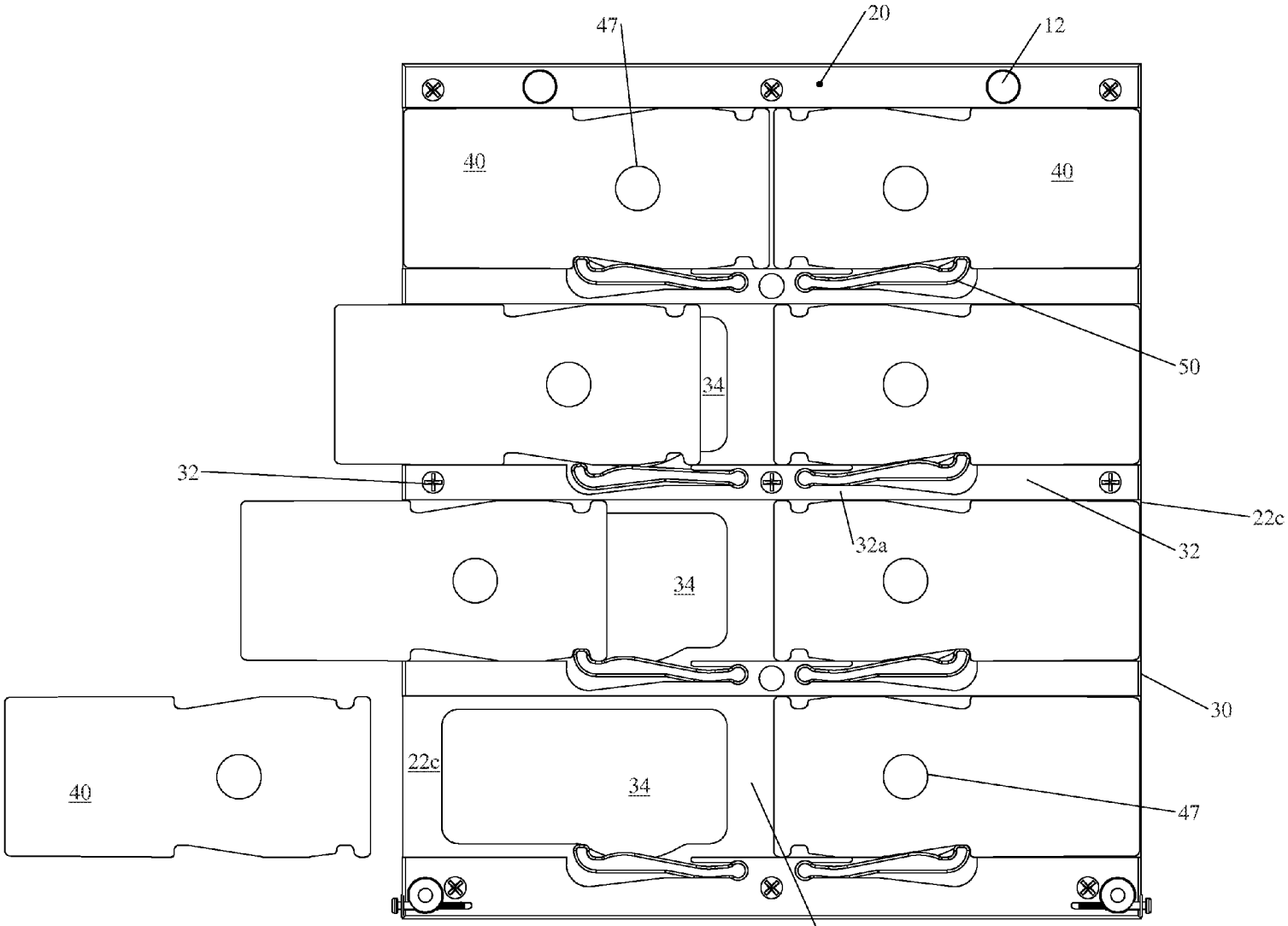
FIG. 4 is a rear view of the messaging sign shown in FIG. 3.

As shown in FIGS. 3 and 4, the frame 20 is a rectangular panel having a top layer 22 and a sectional layer 30. However, it is also possible that frame 20 be prepared from other polygonal shapes, such as a square.

In the embodiment shown, the frame 20 includes apertures formed along an inner body of each layer 22, 30. The apertures form the article receiving sections 34 within an inner body of the frame 20, as well as article receiving openings 36 positioned along an outer edged of the frame 20.

The top layer 22 includes a plurality of article viewing sections 24, which extend along a latitudinal axis of the top layer 22, as well as a plurality of notches 26 along a bottom portion of each article viewing section 24. Each notch 26 is positioned on a left and a right side of each article viewing section 24, respectively, according to the embodiment shown.

As shown in FIG. 3, the top layer 22 is grid shaped, and includes a plurality of outer dividers 22*a* extending along the latitudinal axis and an inner divider 22*b* disposed along a substantially center of the frame 20. The inner divider 22*b* extends along a longitudinal axis of a top layer 22 of the frame 20. An outer wall 22*c* is positioned along the outside of the top layer 22 and extends adjacent the outer dividers 22*a*. Each outer divider 22*a* extends between the central inner divider 22*b* and the outer wall 22*c*. Accordingly, the article viewing sections 24 are disposed between adjacent outer dividers 22*a*, the central inner divider 22*b*, and the outer wall 22*c*. In the embodiment shown, a total of eight article viewing sections 24 are provided. However, one skilled in the art should appreciate one or more article viewing sections 24 could be used.

The top layer 22 is made of from a manufactured material, and may be constructed using a variety of methods, including injection molding, metal stamping, etc. but must be in a manner sufficient to form the article viewing sections 24 and notches 26, which may be manufactured after the frame 20 is formed.

Figure 5:
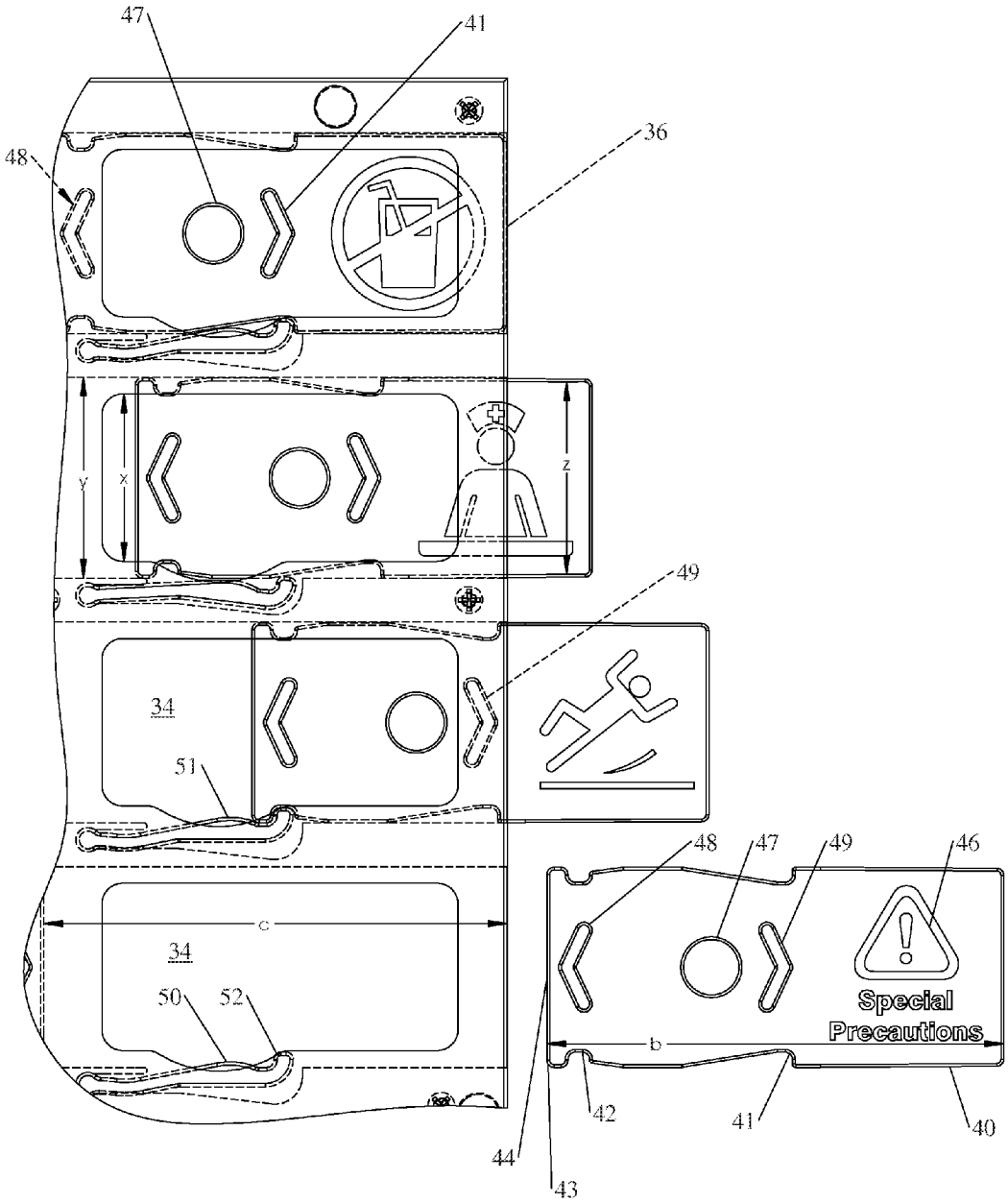
FIG. 5 is a close up front view of the messaging sign shown in FIG. 3.
Figure 6:
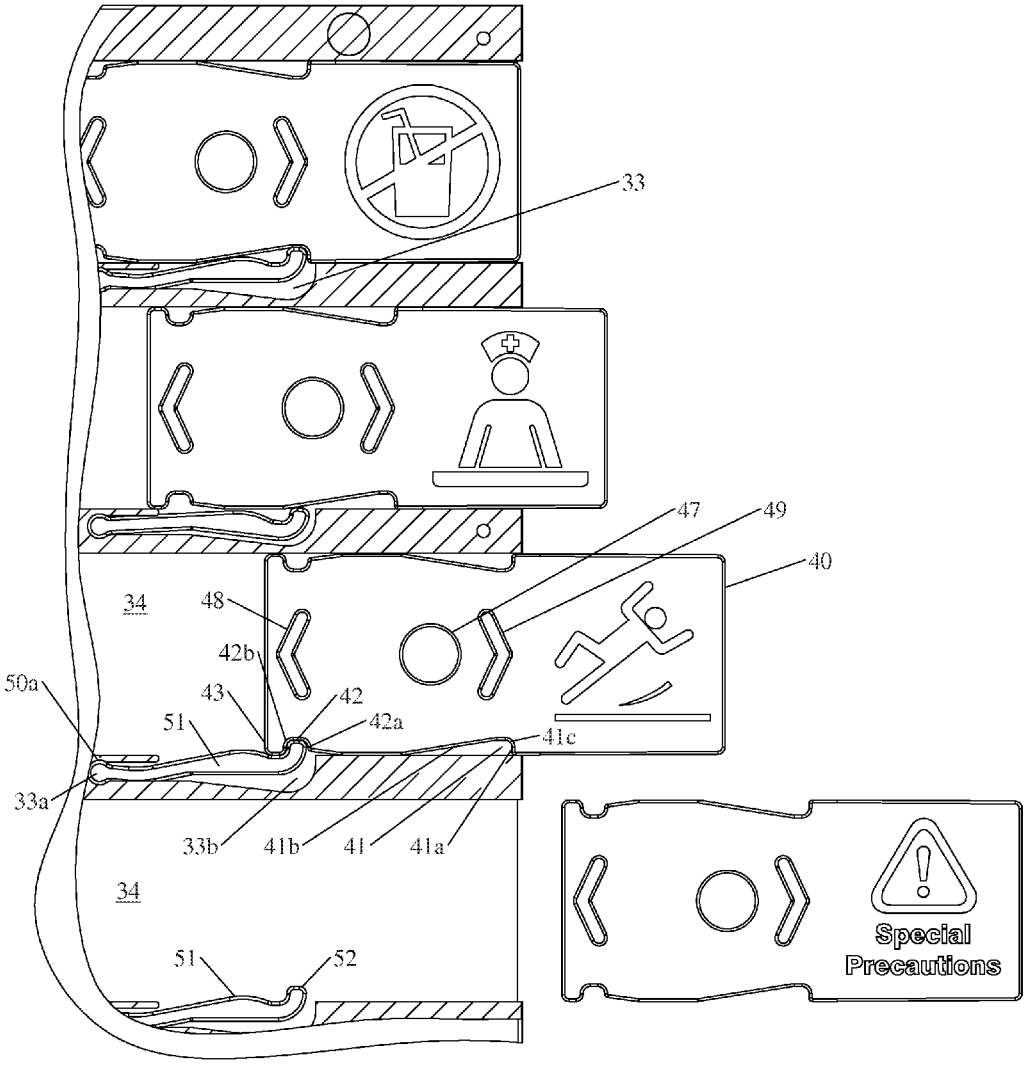
FIG. 6 is a sectional view of the messaging sign in FIG. 5.
Figure 7:
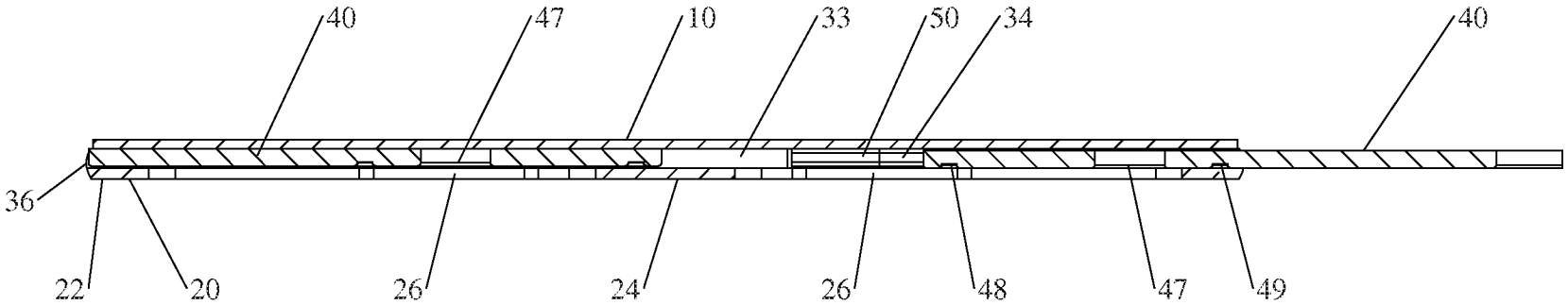
FIG. 7 is a section view of the messaging sign according to the invention, along line 7-7 in of FIG. 3.

As shown in FIGS. 4-6, the sectional layer 30 is also grid shaped. In the embodiment shown, the sectional layer 30 includes a plurality of stringers 32 extending along the latitudinal axis from the outer wall 22*c* to an opposite outer wall 22*c*. In the embodiment shown, each stringer 32 is a rib that extends away from a bottom surface of the outer divider 22*a* and provides the article receiving section 34 between adjacent stringers 32. Furthermore, each stringer 32 corresponds with and extends along the outer divider 22*a* (shown in FIG. 3).

Each stringer 32 includes a fastening member receiving passageway 33 positioned along an inner body thereof. In particular, in the embodiment shown, a pair of fastening member receiving passageways 33 are positioned on opposing sides of the stringer 32.

In the embodiment shown, each fastening member receiving passageway 33 includes a holding section 33*a* and a tip receiving section 33*b*. The holding section 33*a* is a cylindrical recess disposed along an outer surface 32*a* of the stringer 32 and extending therein. In particular, the holding section 33*a* is a cylindrical recess having one open end disposed along the outer surface of the stringer 32 and a closed end disposed on the top layer 22. One skilled in the art would appreciate other shaped recesses are possible. In the embodiment shown, the tip receiving section 33*b* is an indentation disposed along an edge of the stringer 32 and extending into the holding section 33*a*. In the embodiment shown, the tip receiving section 33*b* is also recessed along the outer surface 32*a* to form a notch in the stringer 32.

The frame 20 may also include a securing device 12 positioned on or in the frame 20. In the shown embodiment, the securing device 12 includes a mounting means, such as a magnet, disposed along a top surface of the frame 20.

As shown in FIGS. 4-6, the moveable article 40 is a planar article, and constructed from the manufactured material, like the base 10 and frame 20. However, it is possible that the moveable articles 40 are made from a different material than the base 10 and frame 20.

In the embodiment shown, each moveable article 40 is a planar rectangular card having indicia 46 disposed along a major surface thereof. In the embodiment shown, the indicia 46 are selected symbols that are standard to the health care industry. However, it is possible to include any symbol or text desired by a user in any industry.

As shown in FIGS. 5 and 6, each moveable article 40 includes a first position notch 41, a second position notch 42, and a stopper 43 disposed along outer surface walls of the moveable article 40. In the embodiment shown, the first position notch 41 and the second position notch 42 are positioned along a lower outer wall surface of the moveable article 40, and the stopper 43 is disposed along a surface wall of a trailing end 44 of the moveable article 40.

As shown in FIG. 6, the first position notch 41 is an elongated indentation disposed along the lower outer surface wall and extends inward toward a substantial center thereof. The first position notch 41 includes a receiving section 41*a* that extends into a tapered section 41*b*. The receiving section 41*a* is a shaped recess having a first engagement wall 41*c* along one side thereof. The tapered section 41*b* is an inclined surface wall extending from another side of the receiving section 41*a*, opposite the first engagement wall 41*c*, and toward the outer surface wall. The tapered section 41*b* also extends in a direction toward the second position notch 42, but does not extend into the second position notch 42 in the embodiment shown.

The second position notch 42 is also an indentation disposed along the outer surface wall and apart from the first position notch 41 and disposed adjacent a trailing end 44 of the moveable article 40. The second position notch 42 includes a receiving section shaped and sized similar to the receiving section 41*a*. However, the second position notch 42 includes a pair of stop walls 42*a* positioned on opposite sides of the second position notch 42.

The stopper 43 is a fastening member engaging surface that is disposed along the trailing end 44 of the moveable article 40. In fact, in the embodiment shown, the stopper 43 is the outer wall of the trailing end 44. However, in another embodiment, the stopper 43 may be another indentation, shaped and sized similar to the second position notch 42, but disposed along trailing end 44.

As shown in FIGS. 5 and 6, each moveable article 40 includes a movement member 47, a first movement indicator 48, and a second movement indicator 49.

The movement member 47 is disposed along a major surface of the moveable article 40. The movement member 47 includes a grasping means, such a frictional layer of material, an outward protruding member, a recess, a roughened section of the moveable article 40, or a depression along the major surface of the moveable article 40. In the shown embodiment, the movement member 47 is a recess that extends completely through the moveable article 40, and is viewable on a reversed side.

The first movement indicator 48 is disposed alongside the movement member 47 and adjacent the trailing end 44 of the moveable article 40. In the embodiment shown, the first movement indicator 48 is a shaped recess, such as an arrow, indicating a first direction of movement. The first movement indicator 48 is disposed along one major surface of the moveable article 40.

The second movement indicator 49 is disposed alongside an opposite side of the movement member 47 with respect to the first movement indicator 48. In the embodiment shown, the second movement indicator 49 is a shaped recess, such as an arrow, indicating a second direction of movement, which is an opposite direction of movement with respect to the first direction of movement. The first movement indicator 48 is disposed along one major surface of the moveable article 40. In addition, in the embodiment shown, the second movement indicator 49 is positioned closer to the movement member 47 than the first movement indicator 48.

As shown, the first and second position notches 41, 42 could also be included on both top and bottom outer surface walls of moveable article 40. Additionally, the first and second movement indicators 48, 49 could also be included on both major surfaces of moveable article 40. For instance, the first and second movement indicators 48, 49 could extends through the first and second movement indicators 48, 49, and become visible on both major surfaces thereof.

As clearly shown in FIGS. 4 and 6, the fastening member 50 is an elongated member having a securing end 50*a* and a resilient finger 51 with a finger end 52 and a depression member 53.

The securing end 50*a* is a polygonal shaped member disposed on a first end of the fastening member 50. The finger 51 is a resilient elongated member that extends from the securing end 50*a* and includes a depression member 51*a* disposed along a substantial section thereof. The finger 51 curves away and upward from the securing end 50*a*, and toward the finger end 52. In the embodiment shown, the depression member 53 is a widened section of the finger 51. In the embodiment shown, the finger end 52 is disposed on a second end of the fastening member 50, which is opposite the securing end 50*a*. The finger end 52 in the embodiment shown curves further upward from the finger 51. In the embodiment shown, the finger end 52 includes a curved blunt end. However, it is possible that other shapes and configurations are used without departing from the spirit of the invention.

Figure 8:
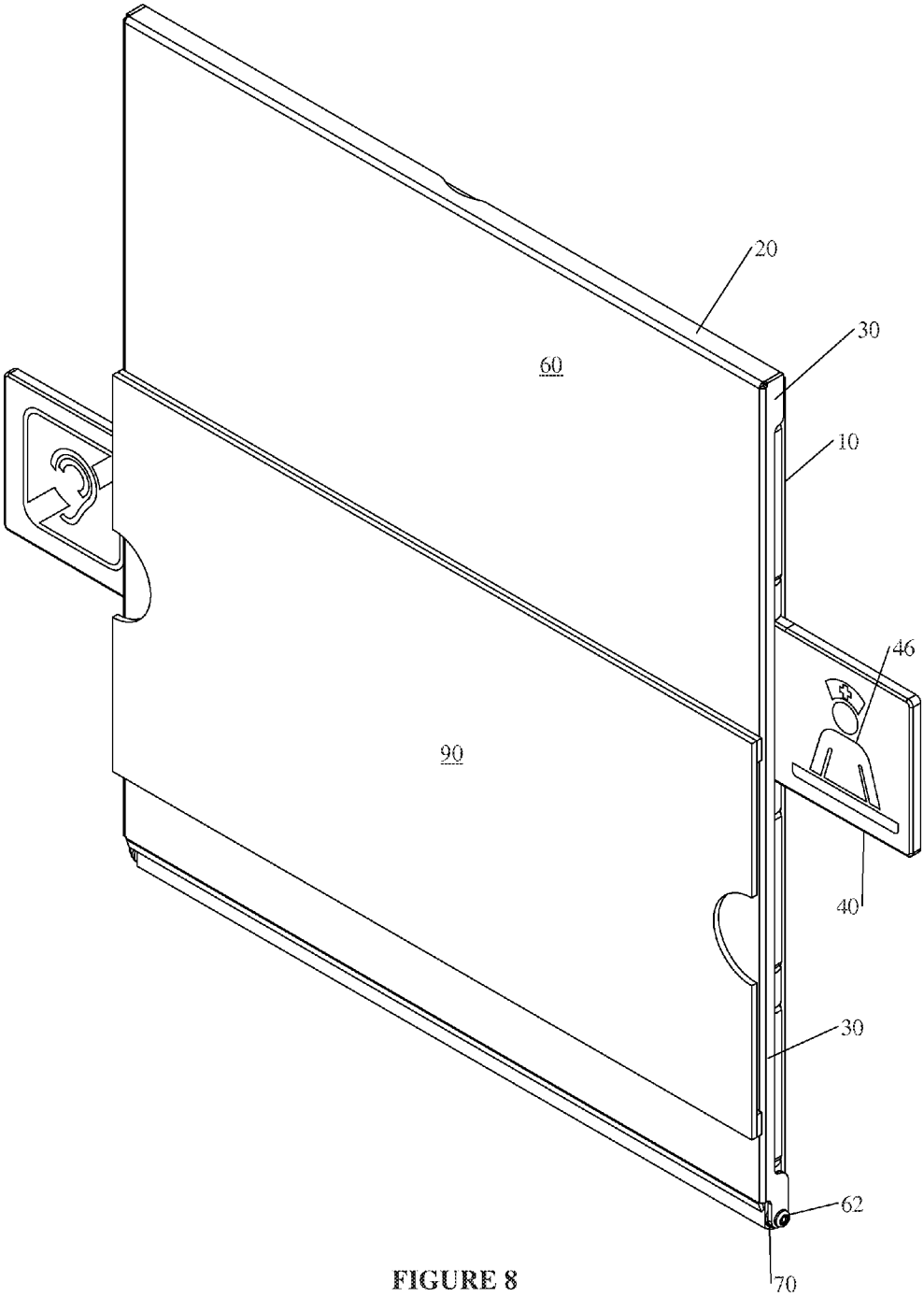
FIG. 8 is a perspective view of the messaging sign according to the invention, showing the cover positioned over the frame.

Now with reference to FIGS. 2 and 8, the cover 60 is shown and includes a receiving section 61 and extensions 62. In the embodiment shown, the receiving section 61 is a rectangular shaped member having a body 61*a* and a plurality of sidewalls 61*b* extending substantially perpendicular from outer surfaces of the body 61*a*. The extensions 62 extend from the receiving section 61 and, more particularly, from a bottom surface of the cover 60. In the embodiment shown, the extensions 62 are tabs extending from a pair of opposite sidewalls 61*b* and extend away there from, along a longitudinal axis of the cover 60. Each extension 62 includes a fastener receiving hole positioned there through.

In the shown embodiment, the cover 60 is metal. However, the cover 60 can be prepared from a manufactured material, like the base 10 and frame 20.

As shown in FIGS. 1 and 8, the cover 60 includes a card slot 90 disposed along an outer surface of the cover 60. In the embodiment shown, the card slot 90 is an enveloped member includes a receiving space for paperwork (not shown) concerning the patient or a plurality of moveable articles 40.

Now with reference to FIGS. 2 and 8, the fastener 70 is a fastener element, such as a screw, bolt, pin, or other known fastener that mechanically joins or affixes two or more objects together.

As shown in FIG. 2, the messaging sign 1 includes a removable sign 80 disposed along the receiving section 61. In the embodiment shown, the removable sign 80 is flat shaped member having signage along one major surface side thereof. The removable sign 80 further includes a mounting means positioned along an opposite surface side thereof. In the embodiment shown, the removable sign 80 includes a magnetic material.

Now with reference to the drawings, an assembly of the messaging sign 1 will be discussed.

Referring first to FIG. 1, the messaging sign 1 is securable to a support surface, such as a wall (not shown), for instance, outside of a patient's room. However, those skilled in the art should appreciate that the messaging sign 1, although shown in the exemplary embodiment as relating to patient care, has other fields of use wherever information needs to be communicated, including consumers and professionals.

In the embodiment, the messaging sign 1 and, in particular, the base 10 attaches to the surface using the adhesive tape on the rear side (not shown) of the messaging sign 1. However, other attachment means are possible, including fasteners, adhesives, or mechanical joints. Additionally, in other embodiments, the base 10 can be omitted, and the support surface acts as a base 10, attaching to the frame 20 and retaining the internal components of the messaging sign 1.

As shown in FIG. 2, the base 10 and the frame 20 have common dimensions, including a height and width, so that the base 10 and frame 20 correspond with each other. In the embodiment shown, the base 10 has a smaller thickness than the frame 20. In the embodiment shown, the base 10 and the frame 20 are connected using fastener assembly 14, which may include known fasteners and fastener receiving passageways (i.e. threaded through-holes). However, it possible to assemble the frame 20 and the base 10 using a variety of connection means, such as adhesives, fasteners, molding techniques, or other known attachment methods or connection components.

As shown in FIGS. 2-4, the base 10 and frame 20 attach together such that the sectional layer 30 is positioned between the base 10 and the top layer 22, and the stringers 32 providing a distance there between. The top layer 22, the sectional layer 30 and the base 10 enclose the article receiving sections 34 within an inner body of the frame 20. Furthermore, when the base 10 connects with frame 20, the article receiving openings 36 are completed along on the outer wall 22*c* of the frame 20, with ends of the stringers 32 separating each article receiving opening 36.

As shown in FIGS. 3 and 4, the top layer 22 and the sectional layer 30 are integrally formed, as a monolithic structure. However, in other embodiments, it is possible that the top and sectional layers 22, 30 are separate layers of manufactured material, which are then rigidly connected together to form the frame 20.

As shown in FIGS. 3-5, the article viewing sections 24 and the article receiving section 34 correspond with each other, such that the stringers 32 align with the outer dividers 22*a* and the article receiving sections 34 align with the article viewing section 24.

The dimensions of article viewing section 24 and the article receiving section 34 are different. The article receiving section 34 wholly receives the moveable article 40 through the article receiving opening 26, which is then partially exposes the moveable article 40. Furthermore, the article viewing section 24 is smaller than the article receiving section 34 so that the moveable article 40 cannot fall through the article viewing section 24.

As shown in FIG. 5, the height x of the article viewing sections 24, along top layer 22, is smaller than the distance y between stringers 32 and the height of the article receiving opening 36. As a result, the moveable articles 40 is received within the formed article receiving sections 34 of the frame 20. The difference in dimensions between the moveable article 40 and the distance between the stringers 32 should be sized to prevent inadvertent movement of the moveable articles 40 when pushed into the article receiving sections 34 between the stringers 32 of the sectional layer 30.

As shown in FIG. 2, the moveable article 40 is substantially the same thickness as the sectional layer 30 so that the moveable article 40 can move through the article receiving opening 36 and into the article receiving section 34.

As further shown in FIG. 4-6, the height z of the each moveable article 40 should be marginally smaller than the distance y between each stringer 32, yet larger than the height x of the formed article receiving sections 34. The moveable article 40 has a width b that is substantially as long as the width c, which is measured from an inner surface of the inner divider 22*b* to article receiving opening 36.

As shown in FIGS. 5 and 6, the moveable article 40 is well received by article receiving section 34. The difference in height z of the moveable article 40 and distance y between stringers 32 should be minimized in the embodiment shown, that way the moveable article 40 may smoothly slide between the stringers 32 when received. As a result, the moveable article 40 is securable within a box like receiving space, but is also capable of freely moving in a linear direction.

As shown in FIG. 4-6, each fastening member receiving passageway 33 is formed within a body of the stringer 32. The holding section 33*a* is sized and shaped to receive and secure one end of the fastening member 50, while the tip receiving section 33*b* is sized to receive the other end of the fastening member 50, such that the fastening member 50 move upward and downward with respect to the stringer 32. In the embodiment shown, the holding section 33*a* is sized such that the fastening member 50 frictionally fits and is secured within the holding section 33*a*. The tip receiving section 33*b* provides greater space between the moveable article 40 (when positioned in the moveable article receiving section 34) and an outer edge of the stringer 32. The fastening member 50 is resilient, biasing the stringer, and can be depressed into the tip receiving section 33*b*.

In the embodiment shown, the notch 26 corresponds with the tip receiving section 33*b* such that the tip receiving section 33*b* can be accessed by a finger or instrument to move the fastening member 50 downward into the tip receiving section 33*b*.

As clearly shown in FIGS. 4 and 6, the fastening member 50 is an elongated member for engaging the moveable article 40. When secured in the stringer 32, the fastening member 50 resiliently biases the stringer 32 and, more particularly, away from the tip receiving section 33*b* and into the article receiving section 34 when the fastening member 50 is secured in the holding section 33*a* and moved toward the stringer 32.

The fastening member 50 is provided on both the left and right sides of the stringer 32 in the shown embodiment. The securing end 50*a* is a polygonal shaped member that corresponds with the fastening member receiving passageway 33 and is received by the holding section 33*a* so that one end (i.e. the securing end 50*a*) the fastening member 50 is secured to frame 20. As discussed, the securing end 50*a* and the holding section 33*a* are frictionally fit with each other so that the fastening member 50 is secured to the stringer 32. In fact, the fastening member receiving passageway 33 and the fastening member 50 are keyed (i.e. shape) with each other in the shown embodiment. For instance, as shown, the securing end 50*a* and the holding section 33*a* are both rounded, such that the securing end 50*a* fits within the holding section 33*a*, and cannot be pulled out of the inner stringer 32 through tip receiving section 33*b*. However, it is also possible to use other designs and configuration that are known to the art to secure the fastening member 50 to the frame 20. For example, in another embodiment, the securing end 50*a* could be integrally formed with the frame 2.

As shown in FIGS. 4-6, the finger end 52 extends into the article receiving section 34 in a resting position. The finger end 52 as a result is engageable with the moveable article 40 when the moveable article 40 is inserted within the article receiving section 34. More particularly, the finger end 52 engages the first position notch 41, the second position notch 42, or the stopper 43, depending on where the moveable article 40 is positioned within the article receiving section 34.

As shown in FIGS. 4-6, the first position notch 41 and the second position notch 42 are positioned along a lower surface of the moveable article 40

The first position notch 41 extends inward from the outer surface wall to receive the finger end 52 of the fastening member 50. The first position notch 41 is shaped and sized to correspondingly receive the finger end 52, such that the first engagement wall 41*c* abuts and holds the finger end 52. The moveable article 40 is designed such that the when the finger end 52 engages the first position notch 41, the moveable article 40 is positioned in a stored position. In addition, the first position notch 41 restricts the moveable article 40 from moving further into the article receiving section 34, since the finger end 52 abuts the receiving section 41*a* and the first engagement wall 41*c*.

The receiving section 41*a* is shaped to correspond with the finger end 52, but is shaped such that the first engagement wall 41*c* engages and obstructs the moveable article 40 from further movement into the article receiving opening 36, when the finger end 52 engages the first engagement wall 41*c*. However, the tapered section 41*b*, positioned opposite the first engagement wall 41*c* with respect to the receiving section 41*a*, is inclined to mechanically move the finger end 52 toward the stringer 32 when the moveable article 40 is moved outward of the article receiving section 34 from the stored position. This results from the inclination of the tapered section 41*b*, which allows the fastening member 50 to resiliently move downward from the receiving section 50, and ride along the outer wall toward the second position notch 42 when moveable article 40 is moved outward of the article receiving section 34.

The second position notch 42 is shaped and sized to receive the finger end 52 of the fastening member 50, such that the pair of stop walls 52*a* hold the finger end 52 when engaged with each other. The second position notch 42 is designed to wholly engage the finger end 52. Since the second position notch 42 does not include a tapered section, the finger end 52 is held within the second position notch 42 until the fastening member 50 pressed downward by a user.

The stopper 43 also abuts the finger end 52 of fastening member 50 when the moveable article 40 is first inserted into article receiving section 34 to prevent inadvertent positioning of the moveable article 40 into article receiving section 34.

In another embodiment, each moveable article 40 include indicia 46 secured on both major sides of the moveable article 40, so that the moveable article 40 can be flipped and the first position notch 41, the second position notch 42, and the stopper 43 along an upper surface can engage the fastening member 50 when positioned in the article receiving section 34. The indicia 46 can be secured to the moveable article 40 surface permanently or temporarily, either during pre-assembly or during operation.

With reference to FIGS. 2 and 9, the cover 60 is dimensioned to receive the frame 20 when the cover 60 is in a closed position (as shown in FIG. 6). In the shown embodiment, the frame 20 is fully received into the receiving section 61, when the cover 60 is rotated to over the frame 20. In the embodiment shown, the receiving section 61 includes an inner depth substantially equal to thickness of the frame 20 to accomplish this feat. However, it is also possible that the cover 60 lies across frame 20, such that the cover 60 restricts access and view of the article viewing sections 24.

In the shown embodiment, each extension 62 receives a fastener 70 that then connects to the frame 20. In the embodiment shown, the cover 60 attaches to the frame 20, so that the cover 60 is rotatably mounted to the frame 20, about the fastener 70. In the shown embodiment, the securing device 12 holds the cover 60 to the frame 20, when rotated to a closed position. However, it is possible that the cover 60 encloses the frame 20 in a variety of closing means, including rotation of the cover 60, sliding of the cover 60, and fastening of the cover 60 over the frame 20, and can be secured using known techniques, such as fasteners, adhesive, Velcro, catches, locks, et.

In the embodiment shown, the cover 60 includes a metal surface so that the removable sign 80 is temporarily secured thereto. However, other attaching means, such as fasteners and adhesive could be used to attach the removable sign 80 to the cover 60 if the cover 60 is magnetic. The removable sign 80 may be housed on the inside surface of the cover 60, and placed on outer surface of the cover 60 when desired. The card slot 90 attaches to the cover 60 using an adhesive, but could be attached using a variety of fastening means.

Now with reference to the drawings, a method of use of the messaging sign 1 will be discussed.

As shown in FIG. 2, selected moveable articles 40 are fitted through the article receiving opening 36 and into the article receiving sections 34 of the frame 20. The base 10 operates as support surface for the moveable article 40 and adjacent stringers 32 act as walls upon which the moveable article 40 may slide in and out of the article receiving section 34. The moveable article 40 are then hidden from view until moved from the stored position to a display position outside the frame 20.

In operation, a user rotates the cover 60 away from the frame 20, exposing frame 20 and article receiving sections 34. The article receiving section 34 is visible through the article viewing section 24, as shown in FIG. 2, so that any inserted moveable article 40 is visible and can be moved by the user.

As shown in FIGS. 4 and 5, the fastening member 50 extends into the article receiving section 34 and resiliently biased away from the stringer 32 in a resting position. The fastening member 50 prevents the moveable article 40 from completely moving into the article receiving section 34.

In order to install the moveable article 40 into the frame 20, the moveable article 40 is first inserted through article receiving section 34. The moveable article 40 moves into the article receiving section 34 and the finger end 52 abuts the stopper 43 of the moveable article 40, hence, stopping the moveable article 40. Since, the fastening member 50 is accessible through the article viewing section 24; the user can depress the fastening member 50 downward into the tip receiving section 33*b*, with assistance from the notch 26, and preventing the fastening member 50 from engaging the moveable article 40. While the fastening member 50 is depressed, the user moves the moveable article 40 further through the article receiving section 34, until the finger end 52 and the receiving section 41*a* of the first position notch 41 can engage each other. As result, the fastening member 50 passes over the stopper 43 and the second position notch 42, and the moveable card 40 is then capable of engaging the first position notch 41. When engaged, the moveable article 40 is held within the article receiving section 34 in thestored position. This ensures that the indicia 46, movement member 47, and the second movement indicator 49 are visible through the article viewing section 24. This is performed for every article receiving section 34, until all the moveable articles 40 and secured in the article receiving sections 34.

Next, the user selects one or more moveable articles 40 to display in the displayed position. This will typically depend upon the desired or required indicia 46. The user then moves the moveable article 40 in a direction according to second movement member 49, which pushes the indicia 46 through the article receiving opening 36, and into the display position. Movement of the moveable article 40 can be ergonomically performed using the movement member 47, for instance, and easily accomplished with one hand.

With reference to FIG. 6, the first position notch 41 facilitates movement of the moveable article 40 into the display position by automatically depressing the fastening member 50 downward. This is performed when the finger end 52 (from a resting position against the first position notch 41) travels along the tapered section 41*b* of the first position notch 41, forcing the finger end 52 to ride along tapered section 41*b*, and move toward the stringer 32 and into the tip receiving section 33*b*. The fastening member 50 then travels along the outer surface wall and into the second position notch 42. Once the fastening member 50 engages the second position notch 42, the moveable article 40 is partially positioned out of the article receiving opening 36, such that the indicia 46 is shown outside of the messaging sign 1. In the display position, only the first movement indicator 48 and movement member 47 are displayable through the article viewing section 24 and the indicia 46 is shown outside of the frame 20 walls. The second movement indicator 49 is hidden from view, such that the first movement indicator 48 display a direction that is required to position the moveable article 40 wholly back into the article receiving section 34 from the refracted position ((i.e. toward the inner divider 22*b*) using the movement member 47.

In order to move the moveable article 40 back into the frame 20, such that the moveable article 40 is wholly received back into the article receiving section 34, the user depresses the fastening member 50 into the tip receiving section 33*b* and slides the moveable article 40 in a direction as indicated by the first movement indicator 48 using the movement member 47. In the embodiment shown, the second position notch 42 prevents movement toward the inner divider 22*b* or further out of the article receiving opening 36.

In order to completely remove the moveable article 40 from the article receiving section 34 and the article receiving opening 36, the user must depress the fastening member 50 from engagement with the moveable article 40 and slide the moveable article 40 completely through article receiving opening 36. Accordingly, different moveable article 40 with different indicia 46 can be used with the frame 20. Additionally, in another embodiment, the moveable article 40 could be flipped over for use in the same article receiving section 34, with different indicia 46 provided on an opposite thereof. Different combinations and positions are available as a result of the aforementioned discussed designs.

Once the user moves selected moveable articles 40 to the display position, the user may then rotate the cover 60 to the closed position (as clearly shown in FIG. 6). Since the fastening member 50 engages the moveable articles 40 into position a retracted position, a person cannot accidentally reposition the displayed moveable article 40 to a retracted position without first opening the cover 60, and then disengaging the fastening member 50.

Additionally, the cover 60 further prevents accidental movement of the moveable articles 40 from retracted position to the display position. Rotating the cover 60, from an open position to a closed position, and vice-versa, can be easily performed easily with one hand.

To change any of the displayed indicia 46, the cover 60 is rotated back into the open position, and the fastening member 50 is pressed downward to disengage with the second position notch 42. The moveable article 40 may be pushed back through the article receiving opening 36 and into the article receiving section 34. The process described above can be performed numerous times to achieve desired results.

Disengagement and movement of the moveable article 40 may be performed with one hand, wherein one finger (not shown) presses the fastening member 50 downward as another finger (not shown) pushes the moveable article 40 back through the article receiving opening 36 and into the article receiving section 34. The cover 60 is closed again until further operation of the moveable articles 40 is required.

As shown in FIGS. 1 and 9, the removable sign 80, which may be housed on the inside of the cover 60, may be repositioned along a front surface of the cover 60. Although the embodiment shows only one removable sign 80, it is possible to provide the user with a plurality of removable signs 80.

In another embodiment, the card slot 90 attaches to the outer surface of the cover 60, as shown in FIG. 2. The user can select additional moveable article 40 stored in the card clot 90 for display with the frame 20. Additionally, the user can store paperwork in the card slot 90.

The foregoing illustrates some of the possibilities for practicing the invention. Many other embodiments and fields of use for the messaging sign 1 are possible and within the scope and spirit of the invention. It is, therefore, intended that the foregoing description be regarded as illustrative rather than limiting, and that the scope of the invention is given by the appended claims together with their full range of equivalents.

What is claimed is:

1. A messaging sign apparatus comprising:

a frame having an article receiving section on an inner body thereof and an article receiving opening on an outer surface and leading into the article receiving section;

a moveable article positioned in the article receiving section and moveable through the article receiving opening to a retracted position opposite the article receiving section; and a resilient fastening member arranged on the frame and engageable with the moveable article to secure one end of the moveable article within the frame and an opposite end positioned outside the frame in a displayed position.

2. The messaging sign apparatus of claim 1, further comprising a cover disposed over the frame and covering the article receiving section.

3. The messaging sign apparatus of claim 2, further comprising a base positioned along the inner body.

4. The messaging sign apparatus of claim 3, wherein the base is a planar surface substantially covering a rear surface of the frame.

5. The messaging sign apparatus of claim 4, wherein the frame includes a top layer having an article viewing section corresponding with the article receiving opening.

6. The messaging sign apparatus of claim 5, wherein the frame further includes a sectional layer having an inner stringer positioned between the base and the top layer and adjacent the article viewing section.

7. The messaging sign apparatus of claim 6, wherein the inner stringer includes a fastening member receiving passageway having a holding section secured to an end of the fastening member.

8. The messaging sign apparatus of claim 7, wherein the fastening member includes a resilient finger extending from the holding section and biasing the inner stringer.

9. The messaging sign apparatus of claim 8, wherein the fastening member receiving passageway includes a tip receiving section extending into the inner stringer to correspond with the resilient finger.

10. The messaging sign apparatus of claim 1, wherein the fastening member is an elongated member secured to the frame and extends into the article receiving section.

11. The messaging sign apparatus of claim 10, wherein the fastening member includes a securing end secured within the frame and a resilient finger engagable with the moveable article.

12. The messaging sign apparatus of claim 11, wherein the resilient finger extends away from the securing end and curves upward to a finger end.

13. The messaging sign apparatus of claim 12, wherein the moveable article includes a first position notch and a second position notch disposed along an outer surface wall of the moveable article.

14. The messaging sign apparatus of claim 13, wherein the first position notch is a recess positioned toward a center of the moveable article.

15. The messaging sign apparatus of claim 14, wherein the first position notch includes a receiving section shaped to receive the fastening member.

16. The messaging sign apparatus of claim 15, wherein the first position notch further includes a tapered section having an inclination between the receiving section and the outer surface wall.

17. The messaging sign apparatus of claim 16, wherein the receiving section receives the fastening member such that the fastening member rides along the tapered section to resiliently move the fastening member toward the frame.

18. The messaging sign apparatus of claim 17, wherein the second position notch is disposed adjacent a trailing end of the moveable article and includes a receiving section shaped and sized to receive the finger end.

19. The messaging sign apparatus of claim 18, wherein the second position notch obstructs linear movement of the moveable article within the article receiving section when engaged with the fastening member.

20. The messaging sign apparatus of claim 12, wherein the finger end further curves upward to a blunt end that corresponds with an outer surface wall of the moveable article.

21. The messaging sign apparatus of claim 20, wherein the moveable article includes a first position notch and a second position notch disposed along the outer surface wall of the moveable article.

22. The messaging sign apparatus of claim 21, wherein the moveable article includes another first position notch and another second position notch along an opposite outer surface wall of the moveable article.

23. The messaging sign apparatus of claim 21, wherein the first position notch is a recess positioned along the outer surface wall and toward a center of the moveable article.

24. The messaging sign apparatus of claim 23, wherein the first position notch is shaped and sized to correspondingly receive the finger end.

25. The messaging sign apparatus of claim 23, wherein the first position notch includes a receiving section and a tapered section extending between the receiving section and the outer surface wall.

26. The messaging sign apparatus of claim 25, wherein the receiving section is shaped to receive a surface side of the finger end.

27. The messaging sign apparatus of claim 26, wherein the tapered section is inclined between the outer surface wall and the receiving section.

28. The messaging sign apparatus of claim 27, wherein the receiving section receives the fastening member and the fastening member rides along the tapered section to move toward the frame.

29. The messaging sign apparatus of claim 23, wherein the second position notch is remote from the first position notch and disposed adjacent a trailing end of the moveable article.

30. The messaging sign apparatus of claim 29, wherein the second position notch includes a receiving section shaped and sized to engage the finger end.

31. The messaging sign apparatus of claim 30, wherein the second position notch obstructs linear movement of the moveable article within the article receiving section when engaged with the fastening member.

32. The messaging sign apparatus of claim 1, wherein the moveable article includes a movement member disposed along a major surface of the moveable article.

33. The messaging sign apparatus of claim 1, wherein the moveable article includes a first movement indicator disposed along a trailing end of the moveable article and shaped to designate a first direction of movement for the moveable article within the article receiving section.

34. The messaging sign apparatus of claim 33, wherein the moveable article includes a second movement indicator remotely located from the first movement indicator and shaped to designate a second opposite direction of movement for the moveable article within the article receiving section.

35. The messaging sign apparatus of claim 34, wherein one of the first movement indicator or the second movement indicator is covered by the frame with the moveable article is positioned in the article receiving section and engaged with the fastening member.

36. A messaging sign apparatus comprising:

a frame having an article receiving section on an inner body thereof, an article receiving opening on an outer surface and leading into the article receiving section, and a top layer having an article viewing section corresponding with the article receiving opening;

a moveable article positioned in the article receiving section and moveable through the article receiving opening to a retracted position opposite the article receiving section;

a fastening member arranged on the frame and engageable with the moveable article to secure one end of the moveable article within the frame and an opposite end positioned outside the frame in a displayed position;

a cover disposed over the frame and covering the article receiving section; and a base positioned along the inner body and having a planar surface substantially covering a rear surface of the frame.

37. A messaging sign apparatus comprising:

a frame having an article receiving section on an inner body thereof and an article receiving opening on an outer surface and leading into the article receiving section;

a moveable article positioned in the article receiving section and moveable through the article receiving opening to a retracted position opposite the article receiving section; and a fastening member arranged on the frame and engageable with the moveable article to secure one end of the moveable article within the frame and an opposite end positioned outside the frame in a displayed position and having an elongated member secured to the frame that extends into the article receiving section.

38. A messaging sign apparatus comprising:

a frame having an article receiving section on an inner body thereof and an article receiving opening on an outer surface and leading into the article receiving section;

a moveable article having a movement member disposed along a major surface of the moveable article and positioned in the article receiving section and moveable through the article receiving opening to a retracted position opposite the article receiving section; and a fastening member arranged on the frame and engageable with the moveable article to secure one end of the moveable article within the frame and an opposite end positioned outside the frame in a displayed position.

39. A messaging sign apparatus comprising:

a frame having an article receiving section on an inner body thereof and an article receiving opening on an outer surface and leading into the article receiving section;

a moveable article positioned in the article receiving section and moveable through the article receiving opening to a retracted position opposite the article receiving section and having a first movement indicator disposed along a trailing end of the moveable article and shaped to designate a first direction of movement for the moveable article within the article receiving section; and a fastening member arranged on the frame and engageable with the moveable article to secure one end of the moveable article within the frame and an opposite end positioned outside the frame in a displayed position.

40. A messaging sign apparatus comprising:

a frame having an article receiving section on an inner body thereof, an article receiving opening located on an outer surface and leading into the article receiving section, a top layer having an article viewing section corresponding with the article receiving opening, and a sectional layer having an inner stringer positioned adjacent the article viewing section;

a moveable article positioned in the article receiving section and moveable through the article receiving opening to a retracted position opposite the article receiving section;

a resilient fastening member arranged on the frame and engageable with the moveable article to secure the moveable article within the frame into different displaying positions;

a cover disposed over the frame and covering the article receiving section; and a base positioned along the inner body and having a planar surface substantially covering a rear surface of the frame, wherein the inner stringer is positioned between the base and the top layer and includes a fastening member receiving passageway having a holding section secured to an end of the fastening member.

41. The messaging sign apparatus of claim 40, wherein the fastening member includes a resilient finger extending from the holding section and biasing the inner stringer.

42. The messaging sign apparatus of claim 41, wherein the fastening member receiving passageway includes a tip receiving section extending into the inner stringer to correspond with the resilient finger.

43. A messaging sign apparatus comprising:

a frame having an article receiving section on an inner body thereof and an article receiving opening on an outer surface and leading into the article receiving section;

a moveable article having a first position notch and a second position notch disposed along the outer surface wall of the moveable article and being positioned in the article receiving section and moveable through the article receiving opening to a retracted position opposite the article receiving section; and a resilient fastening member having an elongated member secured to the frame and extending into the article receiving opening; a securing end secured within the frame, and a resilient finger engagable with the moveable article to secure the moveable article within the frame into different displaying positions;

wherein the resilient finger extends away from the securing end and curves upward to a finger end that curves upward to a blunt end that corresponds with an outer surface wall of the moveable article.

44. The messaging sign apparatus of claim 43, wherein the first position notch is a recess positioned along the outer surface wall and toward a center of the moveable article.

45. The messaging sign apparatus of claim 44, wherein the first position notch is shaped and sized to correspondingly receive the finger end.

46. The messaging sign apparatus of claim 44, wherein the first position notch includes a receiving section and a tapered section extending between the receiving section and the outer surface wall.

47. The messaging sign apparatus of claim 46, wherein the receiving section is shaped to receive a surface side of the finger end.

48. The messaging sign apparatus of claim 47, wherein the tapered section is inclined between the outer surface wall and the receiving section.

49. The messaging sign apparatus of claim 48, wherein the receiving section receives the fastening member and the fastening member rides along the tapered section to move toward the frame.

50. The messaging sign apparatus of claim 44, wherein the second position notch is remote from the first position notch and disposed adjacent a trailing end of the moveable article.

51. The messaging sign apparatus of claim 50, wherein the second position notch includes a receiving section shaped and sized to engage the finger end.

52. The messaging sign apparatus of claim 51, wherein the second position notch obstructs linear movement of the moveable article within the article receiving section when engaged with the fastening member.

53. The messaging sign apparatus of claim 43, wherein the moveable article includes another first position notch and another second position notch along an opposite outer surface wall of the moveable article.

54. A messaging sign apparatus comprising:

a frame having an article receiving section on an inner body thereof and an article receiving opening on an outer surface and leading into the article receiving section;

a moveable article having first position notch and a second position notch disposed along an outer surface wall of the moveable article and positioned in the article receiving section and moveable through the article receiving opening to a retracted position opposite the article receiving section; and a resilient fastening member having an elongated member secured to the frame and extending into the article receiving opening; a securing end secured within the frame, and a resilient finger engagable with the moveable article to secure the moveable article within the frame into different displaying positions;

wherein the resilient finger extends away from the securing end and curves upward to a finger end.

55. The messaging sign apparatus of claim 54, wherein the first position notch is a recess positioned toward a center of the moveable article.

56. The messaging sign apparatus of claim 55, wherein the first position notch includes a receiving section shaped to receive the fastening member.

57. The messaging sign apparatus of claim 56, wherein the first position notch further includes a tapered section having an inclination between the receiving section and the outer surface wall.

58. The messaging sign apparatus of claim 57, wherein the receiving section receives the fastening member such that the fastening member rides along the tapered section to resiliently move the fastening member toward the frame.

59. The messaging sign apparatus of claim 58, wherein the second position notch is disposed adjacent a trailing end of the moveable article and includes a receiving section shaped and sized to receive the finger end.

60. The messaging sign apparatus of claim 59, wherein the second position notch obstructs linear movement of the moveable article within the article receiving section when engaged with the fastening member.

* * * * *